United States Patent [19]

Ishikawa et al.

[11] Patent Number: 4,880,728

[45] Date of Patent: Nov. 14, 1989

[54] PROCESSING METHOD FOR SILVER HALIDE COLOR PHOTOSENSITIVE MATERIALS UTILIZING THE OVERFLOW FROM THE COLOR DEVELOPER

[75] Inventors: Takatoshi Ishikawa; Junya Nakajima, both of Kanagawa, Japan

[73] Assignee: Fuji Photo Film Co., Ltd., Minami-Ashigara, Japan

[21] Appl. No.: 30,352

[22] Filed: Mar. 26, 1987

[30] Foreign Application Priority Data

Mar. 31, 1986 [JP] Japan ..... 61-73595

[51] Int. Cl.[4] ..... G03C 7/30; G03C 7/42; G03C 5/24

[52] U.S. Cl. ..... 430/380; 430/393; 430/398; 430/399; 430/400; 430/421

[58] Field of Search ..... 430/393, 372, 398, 400, 430/421, 463, 430, 399, 380

[56] References Cited

U.S. PATENT DOCUMENTS 4,145,271 3/1979 Nosse et al. ..... 204/182.4
4,163,023 7/1979 Endo et al. ..... 430/399
4,186,007 1/1980 Meckl et al. ..... 430/467
4,207,157 6/1980 Hirai et al. ..... 204/151
4,336,324 1/1982 Koboshi et al. ..... 430/421 Y
4,567,134 1/1986 Koboshi et al. ..... 430/372

OTHER PUBLICATIONS

C.A. 104:43122z "Method of forming dye image", Hirabayashi Shigeto.

*Primary Examiner*—Paul R. Michl
*Assistant Examiner*—Patrick A. Doody
*Attorney, Agent, or Firm*—Burns, Doane, Swecker & Mathis

[57] ABSTRACT

The present invention relates to a processing method for a silver halide color photographic material, which makes it possible to substantially reduce the amount of waste liquor and the pollution of the environments. In the process, the color photosensitive material is continuously developed, and the process is characterized in that all or a part of the overflow of a color developer being substantially free from benzyl alcohol is used as a part of a processing solution used in a process other than the color development process.

11 Claims, No Drawings

PROCESSING METHOD FOR SILVER HALIDE COLOR PHOTOSENSITIVE MATERIALS UTILIZING THE OVERFLOW FROM THE COLOR DEVELOPER

BACKGROUND OF THE INVENTION (1) Field of the Invention

The present invention relates to a processing method for a silver halide color photographic material, in particular to a processing method which makes it possible to substantially reduce the amount of waste liquor and, in turn, the pollution of the environment. In addition, the invention also pertains to a processing method which permits a saving in running cost.

(2) Prior Art

Various kinds of processing solutions have been formulated for processing silver halide color photographic materials, and the processing solution has continuously or periodically been supplemented with replenishing solution during processing, while the overflow thereof has been recovered or discarded. However, in recent years the environment has been disrupted by an increase in effluent industrial waste liquors and the like and therefore, it is desirable to minimize the amount of waste liquor from the viewpoint of environmental protection. For this reason, various processing methods have been investigated. The most general of such methods comprises reducing the amount of processing solution to be supplemented, which is also economically advantageous. Studies have been made regarding the application of this method to a variety of processing solutions such as color developers, bleaching solutions, fixing solutions and bleaching-fixing solutions and it has already been put into practical use. Moreover, other processing methods have also been proposed and disclosed in, for instance, Japanese Patent Un-examined Publication Nos. 57-8543; 57-132146; 58-18631 and 59-184343 wherein even the amount of washing water is substantially saved.

The color developer, among others, has an extremely high biological oxygen demand ($BOD_5$) and chemical oxygen demand (COD), which are considered to be a measure of the degree of environmental pollution, and further has a buffering effect at a high pH region. Therefore, such color developer used cannot be discarded without treatment and there is no merit in recovering the used color developer, since it does not contain any valuable material such as silver. On the contrary, various studies have been conducted regarding recycling the used color developer, since the color developer per se is quite expensive and there have been proposed, for instance, a method utilizing the electrodialysis technique as is disclosed in Japanese Patent Un-examined Publication Nos. 53-7234; 53-37015; 53-149331; 54-19741 and 54-37731; a method using an ion exchange resin as is disclosed in Japanese Patent Un-examined Publication Nos. 52-146236; 53-50737 and 53-96831; West German Patent No. 2,717,674 and the like. According to these methods, it becomes possible to reduce the amount of color developers discharged to some degree. However, these methods require the use of an expensive apparatus and considerable expertise for the maintenance thereof. Such being the case, these methods have been adopted only in a few major laboratories, while in most laboratories the recycling of the color developer has not yet been carried out.

SUMMARY OF THE INVENTION

It is, therefore, a primary object of the present invention to provide a processing method for a silver halide color photographic material which permits a substantial reduction in the amount of waste liquor and, in turn, the degree of environmental pollution and in particular a substantial reduction in the amount of color developer discharged.

The aforementioned purpose can be accomplished by using all or a part of the overflow of a color developer as part of a processing solution used in a process other than the color development process in a method for continuously developing a silver halide color photographic material.

This and other objects of the present invention will be clear from the following description.

DESCRIPTION OF THE PREFERRED EMBODIMENTS

In general, a replenishing solution for different kinds of processing solution which is used in processes carried out after the developing process is prepared by dissolving or diluting a concentrated processing agent in or with water (sometimes hot water). While, according to the process of this invention, the overflow of the color developer is used instead of a diluent such as water for different processing solutions other than color developer so as to reduce the amount of color developer discharged. In this respect, the inventors of this invention have found that a replenishing solution for a bleaching solution, a bleaching-fixing solution or a fixing solution, among others, can be maintained at a satisfactory level of performance of the replenishing solution by simply adjusting the pH of the replenishing solution, even if the overflow of color developer is used as the dilute for preparing the replenishing solution therefor. This fact can in no way be inferred from the teachings and disclosure of the conventional techniques. In a continuous processing method, it is preferred that all or a part of the overflow of the color developer be directly introduced into one of the subsequent baths such as the bleaching bath, bleaching-fixing bath or fixing bath, while each of the concentrated solutions is introduced into the corresponding bath to substantially prepare each replenishing solution in situ so as to decrease the amount of the color developer to be discharged. Particularly, when the overflow of the color developer is finally introduced into the bleaching-fixing bath and/or the fixing bath, the overflow from each bath other than developing bath is considered to be a valuable material since it contains silver ions and, on the other hand, the cost for recovering the used color developer is substantially saved or entirely eliminated. Such method is quite preferable in view of reducing cost. Moreover, if all or a part of the overflow of the color developer is introduced into the bleaching bath, the overflow from the bleaching bath may further be introduced into the fixing bath or the bleaching-fixing bath, which also results in a reduction in cost.

In addition to the aforementioned method for using the overflow from color developing bath, it is also possible to use the overflow in another manner which comprises previously admixing the same with concentrate for preparing a replenishing solution used in a processing process other than the developing process and supplementing the replenishing solution to the corresponding processing bath.

In the method of this invention, any amount of the overflow from the bath for development processing may be added to any one of the subsequent processing solutions so far as the properties of the bath concerned is not greatly influenced by the addition thereof. However, the overflow solution of the color developer is desirably added to any one of the subsequent baths in an amount of 0.1 to 30 times the volume of the front bath solution carried over by light-sensitive material treated, preferably 0.2 to 5 times thereof (the amount of the overflow does not include the amount of color developer entrained with the material). Moreover, the overflow is suitably used in an amount of 0.2 to 5 times, preferably 0.5 to 3 times (weight basis) the amount of a concentrated replenishing solution. The term "overflow solution" as used herein is defined as a solution discharged out of a tank (or bath) containing the processing solution to always maintain a constant volume of the corresponding processing solution when a replenishing solution is continuously or periodically supplied to the tank. The overflow is in general discharged out of the tank by utilizing the difference in solution levels or by means of a pump or the like.

When the overflow is added to an intended processing solution, it is preferable that the pH of the overflow added in previously adjusted to that of the corresponding processing both, such as bleaching bath, bleaching-fixing bath or fixing bath, by the addition of a weak or strong inorganic or organic acid.

Moreover, the overflow solution from water washing process as the subsequent process may preferably be used as a part of processing solutions other than the developer, in addition to the aforementioned overflow and thus the amount of waste liquor can be further reduced.

The processing method according to the present invention will now be explained more concretely. However, the following explanation is not intended to restrict the invention to specific embodiments described. In the following description, the arrows indicate the direction of flow of all or a part of the overflow solution.

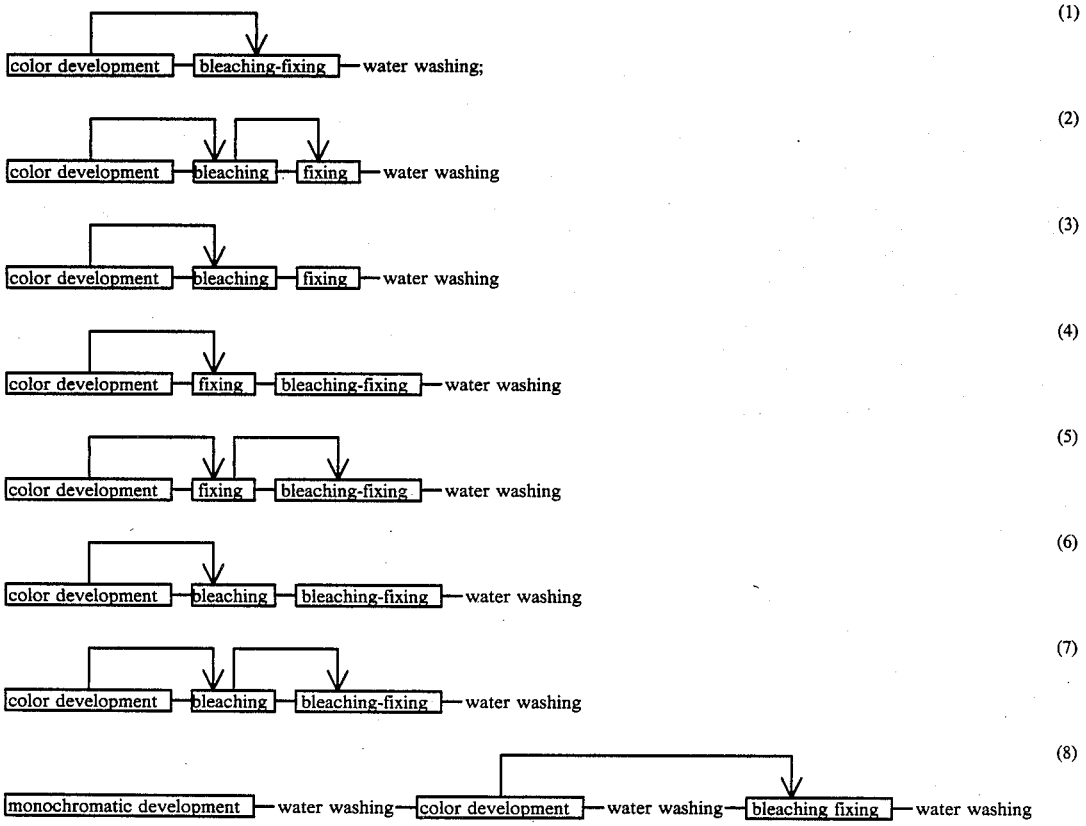

In the foregoing processes, a stabilizing bath may be disposed behind the final water washing process according to need. Moreover, it is also preferable to adopt a method which permits a substantial decrease in the amount of washing water as disclosed in, for instance, Japanese Patent Un-examined Publication No. 57-132146 or a so-called "stabilization processing" as disclosed in, for instance, Japanese Patent Unexamined Publication No. 57-8543, instead of the foregoing water washing process. When adopting these water saving processing methods, all or a part of the overflow solution of the washing water may be introduced into a front bath such as bleaching-fixing bath or fixing bath.

Each processing bath as used herein will hereunder be explained in more detail.

Color development bath

The primary aromatic amine type color development agents which can be used in the color development solution as used herein include conventional ones widely used in a variety of color photography processes. Examples of these developers are aminophenolic derivatives and p-phenylenediamine type derivatives. Preferred are derivatives of p-phenylenediamine and typical examples thereof include the following compounds simply listed by way of example:

D-1: N,N-diethyl-p-phenylenediamine;
D-2: 2-amino-5-diethylaminotoluene;
D-3: 2-amino-5-(N-ethyl-N-laurylamino)toluene;
D-4: 4-[N-ethyl-N-(β-hydroxyethyl)amino]aniline;
D-5: 2-methyl-4-[N-ethyl-N-(β-hydroxyethyl-)amino]aniline;
D-6: N-ethyl-N-(β-methanesulfonamidoethyl)-3-methyl-4-aminoaniline;
D-7: N-(2-amino-5-diethylaminophenylethyl)methanesulfonamide;
D-8: N,N-dimethyl-p-phenylenediamine;
D-9: 4-amino-3-methyl-N-ethyl-N-methoxyethylaniline;
D-10: 4-amino-3-methyl-N-ethyl-N-β-ethoxyethylaniline;
D-11: 4-amino-3-methyl-N-ethyl-N-β-butoxyethylaniline.

These derivatives of p-phenylenediamine may be salts such as sulfates, hydrochlorides, sulfonates and p-toluenesulfonates. These compounds are disclosed in, for example, U.S. Pat. Nos. 2,193,015; 2,552,241; 2,566,271; 2,592,364; 3,656,950 and 3,698,525. These primary aromatic amines used as the developing agent are used in an amount of about 0.1 g to about 20 g per liter of developing solution and more preferably about 0.5 g to about 10 g.

As is well known, the color developer as used herein can contain hydroxylamines. Although, the hydroxylamines may be used in the form of free amines, it is more general to use the same in the form of a water-soluble salt. Typical examples of such salts include sulfates, oxalates, chlorides, phosphates, carbonates and acetates The hydroxylamines may be substituted with substituents or unsubstituted and may further be substituted with an alkyl group at their nitrogen atom.

The preferred amount of the hydroxylamine added is in the range of from 0 to 10 g per liter of the color developer, more preferably 0 to 5 g. The hydroxylamine is preferably used in a rather small amount within the range that the stability of the color developer can be assured.

Moreover, the color developer used in the present invention preferably contains a preservative, for example, a sulfite, metasulfite or bisulfite such as sodium sulfite, potassium sulfite, sodium bisulfite, potassium bisulfite, sodium metasulfite and potassium metasulfite; and adducts of carbonylsulfite. The amount of the preservative preferably falls within the range of from 0 to 20 g/l, more preferably 0 to 5 g/l. Similarly, the preservative is preferably used in a small amount within the range that the stability of the color developer is maintained.

Other preservatives may also be used in the color developer as used herein and include aromatic polyhydroxy compounds such as those disclosed in Japanese Patent Unexamined Publication Nos. 52-49828; 56-47038; 56-32140; and 59-160142 and U.S. Pat. No. 3,746,544; hydroxyacetones such as those disclosed in U.S. Pat. No. 3,615,503 and British Patent No. 1,306,176; α-aminocarbonyl compounds such as those disclosed in Japanese Patent Un-examined Publication Nos. 52-143020 and 53-89425; different kinds of metal salts such as those disclosed in Japanese Patent Un-examined Publication Nos. 57-44148 and 57-53749; a variety of sugars disclosed in Japanese Patent Un-examined Publication No. 52-102727; hydroxamic acids disclosed in Japanese Patent Un-examined Publication No. 52-27638; α,α'-dicarbonyl compounds disclosed in Japanese Patent Un-examined Publication No. 59-160141; salicylic acids disclosed in Japanese Patent Un-examined Publication No. 59-180588; alkanol amines described in Japanese Patent Un-examined Publication No. 54-3532; poly(alkyleneimines) described in Japanese Patent Un-examined Publication No. 56-94349; and derivatives of gluconic acid disclosed in Japanese Patent Un-examined Publication No. 56-75647. These preservatives may be used in combination according to need. In particular, the preservatives such as 4,5-dihydroxy-m-benzene disulfonic acid, poly(ethyleneimine) and triethanolamine are preferably added to the color developer.

The pH value of the color developer as used herein preferably falls within the range of 9 to 12, more preferably 9 to 11.0. The color developer may further contain other ingredients of known color developers.

To assure the aforementioned pH value any of a variety of buffering agents are preferably used. As such buffering agent, there may be used, for instance, carbonates, phosphates, borates, tetraborates, hydroxybenzoates, glycine salts, N,N-dimethylglycine salts, leucine salts, norleucine salts, guanine salts, 3,4-dihydroxyphenylalamine salt, alanine salts, aminobutyric acid salts, 2-amino-2-methyl-1,3-propanediol salts, valine salts, proline salts, trishydroxyaminomethane salts and lysine salts. The carbonates, phosphates, tetraborates and hydroxybenzoates, among others, are excellent in solubility in the color developer and buffering effect at a high pH region of 9.0 or more, have no influence such as fogging on the photographic properties when they are added to the developer, and are in expensive. Therefore, it is particularly preferred to use these buffering agents in the color developer as used in the present invention.

Concrete examples of such buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not restricted to these specific compounds.

The amount of the buffering agent added to the color developer is preferably equal to or more than 0.1 mole/l and the particularly preferred amount thereof falls within the range of 0.1 mole/l to 0.4 mole/l. It is not desirable to use an excess amount of buffering agent, since the pH value of a processing bath to which the overflow is added becomes undesirably high in such case.

Furthermore, the color developer as used in the present invention may contain any of various kinds of chelating agents as the suspension agent for calcium or magnesium ions or for the purpose of improving the stability of the color developer.

Preferred chelating agents are organic acid compounds and include, for instance, aminopolycarboxylic acids such as those disclosed in Japanese Patent Publication Nos. 48-030496 and 44-30232; organophosphonic acids such as those described in Japanese Patent Un-examined Publication No. 56-97347, Japanese Patent Publication No. 56-39359 and West German Patent No. 2,227,639; phosphonocarboxylic acids such as those disclosed in Japanese Patent Un-examined Publication Nos. 52-102726; 53-42730; 54-121127; 55-126241 and 55-65956; and compounds such as those described in Japanese Patent Unexamined Publication Nos. 58-195845 and 58-203440 and Japanese Patent Publication No. 53-40900. Typical and non-limitative examples thereof are as follows:

nitrilotriacetic acid;
diethyleneaminopentaacetic acid;
triethylenetetraminehexaacetic acid;
N,N,N-trimethylenephosphonic acid;
ethylenediamine-N,N,N',N'-tetramethylenephosphonic acid;
1,3-diamino-2-propanol-tetraacetic acid;
trans-cyclohexanediaminetetraacetic acid;
nitrilotripropionic acid;
1,2-diaminopropanetetraacetic acid;
hydroxyethyliminodiacetic acid;
glycol ether diaminotetraacetic acid;
hydroxyethylenediaminetriacetic acid;
ethylenediamineorthohydroxyphenylacetic acid;
2-phosphonobutane-1,2,4-tricarboxylic acid;
1-hydroxyethane-1,1-diphosphonic acid;
N,N'-bis(2-hydroxybenzyl)ethylenediamine-N,N'-diacetic acid.

These chelating agent may be used in combination according to need. Moreover, the chelating agent is used in an amount sufficient to sequester metallic ions present in the color developer, which, for example, falls within the range of from about 0.1 g to 10 g per liter of the developer.

The color developer may also contain a development accelerator, if necessary.

Examples of such development accelerators include thioether type compounds such as those disclosed in Japanese Patent Publication Nos. 37-16088; 37-5987; 38-7826; 44-12380 and 45-9019, U.S. Pat. No. 3,813,247 and the like; p-phenylenediamine type compounds such as those disclosed in Japanese Patent Un-examined Publication Nos. 52-49829 and 50- 15554; quaternary ammonium salts such as those disclosed in, for example, Japanese Patent Un-examined Publication Nos. 50-137726; 56-156826 and 52-43429 and Japanese Patent Publication No. 44-30074; p-aminophenols such as those disclosed in U.S. Pat. Nos. 2,610,122 and 4,119,462; amine type compounds such as those described in, for example, U.S. Pat. Nos. 2,494,903; 3,128,182; 4,230,796; 3,253,919; 2,482,546; 2,596,926 and 3,582,346 and Japanese Patent Publication No. 41-11431; polyalkylene oxides such as those disclosed in, for instance, Japanese Patent Publication Nos. 37-16088; 42-25201; 41-11431 and 42-23883 and U.S. Pat. Nos. 3,128,183 and 3,523,501 as well as 1-phenyl-3-pyrazolidones, hydrazines, mesoionic compounds, thionic compounds, imidazoles or the like. Thioether type compounds and 1-phenyl-3-pyrazolidones, among others, are preferred.

To the color developer used in the present invention, there may be added any of antifoggants according to need. Examples thereof include alkali metal halides such as potassium bromide, sodium bromide, potassium iodide and organic antifoggants. The organic antifoggants include, for example, nitrogen atom-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-triazolyl-benzimidazole, 2-thiazolylmethylbenzimidazole and hydroxyazaindolizine; and mercapto substituted heterocyclic compounds such as 1-phenyl-5-mercaptotetrazole, 2-mercaptobenzimidazole and 2-mercaptobenzothiazole; adenine and mercapto substituted aromatic compounds such as thiosalicylic acid. Particularly preferred are nitrogen atom-containing heterocyclic compounds. These antifoggants may also be incorporated in a color light-sensitive material so that they are dissolved in a processing solution and accumulated therein during processing. However, it is preferable that the amount of the antifoggant accumulated be as low as possible from the viewpoint of the reduction in the amount of waste liquor.

It is desirable to add a fluorescent whitening agent to the color developer used in the present invention. Preferred examples of such fluorescent whitening agents include 4,4'-diamino-2,2'-disulfostilbene type compounds and the amount thereof is preferably in the range of 0 to 5 g/l, more preferably 0.1 to 2 g/l.

To the color developer, there may further be added any of a variety of surfactants, for instance, alkylsulfonic acids, arylsulfonic acids, aliphatic carboxylic acids and aromatic carboxylic acid, according to need.

It is preferred that the color developer used in the present invention be substantially free from benzyl alcohol. That is, if an overflow solution of the color developer containing benzyl alcohol is recycled to a bleaching solution or a bleaching-fixing solution, the presence of benzyl alcohol may cause undesirable staining and the conversion of a cyan dye to leuco dye. The term "substantially free from" as used herein means that the benzyl alcohol is present in an amount of not more than 2 ml per liter of the color developer, preferably not more than 0.5 ml and more preferably it is not present at all.

The temperature of the color developer used in the present invention during processing is preferably 20° to 50° C., more preferably 30° to 40° C. The time required for processing a color light-sensitive material by means of the color developer falls within the range of from 20 seconds to 10 minutes, more preferably 30 seconds to 5 minutes. The amount of replenishing solution to be added is in the range of 30 ml to 2000 ml per unit area (square meter) of the light-sensitive material processed, preferably 30 ml to 1500 ml. From the viewpoint of the reduction in the amount of waste liquor, the replenishing solution is preferably supplied in a smaller amount.

Bleaching solution, bleaching-fixing solution, fixing solution

In the bleaching solution or bleaching-fixing solution which can be used in the method of this invention, the bleaching agent may be, for instance, a complex of ferric ion, in other words a complex of ferric ion and a chelating agent such as an aminopolycarboxylic acid, an aminopolyphosphonic acid or a salt thereof. Examples of the aminopolycarboxylic acid salts or aminopolyphosphonic acid salts include alkali metal salts, ammonium salts and water-soluble amine salts of aminopolycarboxylic acid or aminopolyphosphonic acid. As such alkali metal, there may be mentioned, for example, sodium, potassium and lithium, while as the water-soluble amine, there can be mentioned, for example, alkylamines such as methylamine, diethylamine, triethylamine and butylamine; alicyclicamines such as cyclohexylamine; arylamines such as aniline and m-toluidine; and heterocyclic amines such as pyridine, morpholine and piperidine.

Typical examples of the chelating agents such as aminopolycarboxylic acid, aminopolyphosphonic acid or a salt thereof include compounds listed below:

ethylenediaminetetraacetic acid;
disodium ethylenediaminetetraacetate;
diammonium ethylenediaminetetraacetate;
tetra(trimethylammonium) ethylenediaminetetraacetate;
tetrapotassium ethylenediaminetetraacetate;
tetrasodium ethylenedaminetetraacetate;
trisodium ethylenediaminetetraacetate;
diethylenetriaminepentaacetic acid;
pentasodium diethylenetriaminepentaacetate;
ethylenediamine-N-(β-oxyethyl)-N,N',N'-triacetic acid;
trisodium ethylenediamine-N-(β-oxyethyl)-N,N',N'-triacetate;
triammonium ethylenediamine-N-(β-oxyethyl)-N,N',N'-triacetate;
propylenediaminetetraacetic acid;
disodium propylenediaminetetraacetate;
nitrilotriacetic acid;
trisodium nitrilotriacetate;
cyclohexanediaminetetraacetic acid;
disodium cyclohexanediaminetetraacetate;
iminodiacetic acid;
dihydroxyethyl glycine;
ethyl ether diaminetetraacetic acid;
glycol ether diaminetetraacetic acid;
ethylenediaminetetrapropionic acid;
phenylenediaminetetraacetic acid;
1,3-diaminopropanol-N,N,N',N'-tetramethylenephosphonic acid;
ethylenediamine-N,N,N',N'-tetramethylenephosphonic acid;
1,3-propylenediamine-N,N,N',N'-tetramethylenephosphonic acid.

It is a matter of course that the invention is not restricted to those specific chelating agents.

The complex salt of ferric ions may be used as it is or it may be formed in situ by separately adding a ferric salt such as ferric sulfate, ferric chloride, ferric nitrate, ammonium ferric sulfate and ferric phosphate; and a chelating agent such as an aminopolycarboxylic acid, an aminopolyphosphonic acid and a phosphonocarboxylic acid to a solution. The complex salt per se may be used independently or in combination; the complex salts formed in situ by using a ferric salt and a chelating agent be used alone or in combination; and, moreover, the chelating agents may also be used in combination. In any case, the chelating agents may be used in an amount exceeding that required to form a desired amount of ferric ion complex salt. Among complexes of ferric ion preferred are complexes of ferric ion-aminocarboxylic acid and the amount thereof used is in the range of from 0.01 to 1.0 mole/l, preferably 0.05 to 0.50 mole/l.

In addition, a bleaching accelerator may be optionally added to the bleaching solution or bleaching-fixing solution as used herein Concrete examples of such useful bleaching accelerators include compounds having mercapto groups or disulfide groups such as those disclosed in, for instance, U.S. Pat. No. 3,893,858; West German Patent Nos. 1,290,812 and 2,059,988; Japanese Patent Un-examined Publication Nos. 53-32736; 53-57831; 53-37418; 53-65732; 53-72623; 53-95630; 53-95631; 53-104232; 53-124424; 53-141623 and 53-28426 and Research Disclosure No. 17129 (July, 1978); thiazolidine derivatives such as those disclosed in Japanese Patent Unexamined Publication No. 50-140129; thiourea derivatives disclosed in Japanese Patent Publication No. 45-8506, Japanese Patent Un-examined Publication Nos. 52-20832 and 53-32735 and U.S. Pat. No. 3,706,561; iodides disclosed in West German Patent No. 1,127,715 and Japanese Patent Un-examined Publication No. 58-16235; polyethylene oxides disclosed in West German Patent Nos 966,410 and 2,748,430; polyamine compounds disclosed in Japanese Patent Publication No. 45-8836; as well as compounds disclosed in Japanese Patent Unexamined Publication Nos. 49-42434; 49-59644; 53-94927; 54-35727; 55-26506 and 58-163940 and iodide and bromide ions. Among others, compounds having mercapto group(s) or disulfide group(s) are preferred examples because of their strong acceleration effect and particularly preferred compounds are those disclosed in U.S. Pat. No. 3,893,858, West German Patent No. 1,290,812 and Japanese Patent Un-examined Publication No. 53-95630.

In addition to the aforementioned ingredients, the bleaching solution or bleaching-fixing solution as used herein may also contain a rehalogenation agent, for example, bromides such as potassium bromide, sodium bromide and ammonium bromide; or chlorides such as potassium chloride, sodium chloride and ammonium chloride; or iodides such as ammonium iodide. Moreover, to these processing solutions as used herein, there may optionally be added at least one member selected from the group consisting of inorganic acid, organic acid and an alkali metal or ammonium salts thereof having pH buffering effect, for example, boric acid, borax, sodium metaborate, acetic acid, sodium acetate, sodium carbonate, potassium carbonate, phosphorous acid, phosphoric acid, sodium phosphate, citric acid, sodium citrate and tartaric acid; or a anticorrosive such as ammonium nitrate and guanidine.

The fixing agent used in the fixing solution or bleaching-fixing solution as used herein may be a known one, for example, water-soluble silver halide solvents which include thiosulfates such as sodium thiosulfate, ammonium thiosulfate; thiocyanates such as sodium thiocyanate, ammonium thiocyanate; thioether compounds such as ethylenebisthioglycolic acid, 3,6-dithia-1,8-octanediol; and thioureas. These fixing agents may be used singly or in combination. In addition, it is also possible to use a specific bleaching-fixing solution comprising a combination of a fixing agent disclosed in Japanese Patent Un-examined Publication No. 55-155354 with a large amount of a halide such as potassium iodide, or the like. In the present invention, a thiosulfate, in particular ammonium thiosulfate is preferably used.

The amount of the fixing agent preferably falls within the range of from 0.3 to 2 moles per liter of the processing solution, more preferably from 0.5 to 1.0 mole.

The preferred pH range of the bleaching-fixing solution or fixing solution as used herein is 3 to 10 and the particularly preferred range is 5 to 9. This is because, if the pH value is less than the lower limit, the desilvering property of these solutions is improved but the solutions are deteriorated and the conversion of a cyan dye to leuco dye is promoted. On the other hand, if the pH exceeds the aforementioned upper limit, the desilvering rate becomes low and stains are liable to form during processing.

In order to adjust the pH of these solutions, it is also possible to add a compound such as hydrochloric acid, sulfuric acid, nitric acid, acetic acid, bicarbonates, ammonia, caustic potash, caustic soda, sodium carbonate or potassium carbonate, according to need.

As regards the bleaching-fixing solution, it may also contain, for instance, a variety of fluorescent brighteners, anti-foaming agents, surfactant, polyvinyl pyrrolidone or organic solvents such as methanol.

The bleaching-fixing solution or fixing solution used in the present invention contains a compound releasing sulfite ions, as the preservative, such as sulfites (e.g., sodium sulfite, potassium sulfite, ammonium sulfite); bisulfites (e.g., ammonium bisulfite, sodium bisulfite, potassium bisulfite) and metabisulfites (e.g., potassium metabisulfite, sodium metabisulfite, ammonium metabisulfite). These compounds are preferably present in the solutions in an amount of about 0.02 to 0.50 mole/l (converted to bisulfite ions), more preferably 0.04 to 0.40 mole/l.

A sulfite is in general used as the preservative, but other preservatives such as ascorbic acid, carbonylbisulfite adducts or a carbonyl compound may also be used.

In addition, buffering agents, fluorescent brighteners, chelating agents, anti-fungus agents or the like may be added to the solutions according to need.

The washing process of the method according to the present invention will now be explained below. In the method of this invention, a simplified processing method may be adopted, in which only a so-called "stabilization processing" is included instead of a common "water washing process" while eliminating a substantial washing process. The term "water washing process" herein is thus used in a broad sense inclusive of the aforementioned embodiments.

It is difficult to clearly define the amount of washing water in the washing processing since it varies depending on the number of baths included in a multistage counterflow washing system and the amount of the front bath compounds entrained with the light-sensitive material treated. However, the amount thereof is defined in the present invention so that the concentration of the components of the bleaching-fixing solution in the final washing bath is not more than $1\times10^{-4}$. For example, when a three stage (three tank) counterflow washing system is adopted, the amount of washing water is preferably at least about 1000 ml per unit area (square meter) of the light-sensitive material and the particularly preferred amount is not less than 5000 ml. While if a water saving processing method is selected, it is preferable to use 100 to 1000 ml of washing water per unit area (1 $m^2$) of light-sensitive material processed.

The temperature of the washing water is in the range of 15° to 45° C., particularly 20° to 35° C.

The washing water may contain various known compounds for the purposes of, for instance, preventing the formation of precipitates or stabilizing the washing water. Such compounds, optionally addable to the washing water, include chelating agents such as inorganic phosphoric acids, aminopolycarboxylic acid and organic phosphonic acids; bactericides or anti-fungus agents for inhibiting the propagation of a variety of bacteria, algae or mold, such as those disclosed in J. Antibact. Antifung. Agents, 1983, 11-5, 207–223 and those disclosed in "Bokin Bobai no Kagaku (Chemistry for inhibition of bacteria and fungi)", Hiroshi Horiguchi; metal salts represented by magnesium salts and aluminum salts; alkali metal salts and ammonium salts; or agents such as surfactants for preventing unevenness or for reducing drying load. Moreover, compounds such as those disclosed in, for instance, Phot. Sci. Eng., 1965, 6, 344–359, (L. E. West) may be added to the washing water.

The method according to the present invention is particularly effective in the case where a chelating agent, a bactericide and an anti-fungus agent are added to the washing water and it is intended to substantially save the amount of washing water by adopting a multistage counterflow washing system including at least two baths. Moreover, the method of this invention can also be effectively carried out when a multistage counterflow stabilization process (so-called stabilization processing) disclosed in Japanese Patent Unexamined Publication No. 57-8543 is utilized instead of the usual water washing process. In these cases, the concentration of the components contained in the bleaching-fixing solution should be in the range of not more than $5\times10^{-2}$, preferably at most $1\times10^{-2}$, in the final washing bath.

On the aforementioned stabilizing bath, various kinds of compounds other than the foregoing additives are added for the purpose of the stabilization of images. Typical examples of such compounds include a variety of buffering agents for adjusting the pH value of membranes of the processing machine (e.g., to pH 3 to 8), such as a combination of borates, metaborates, borax, phosphates, carbonates, potassium hydroxide, sodium hydroxide, aqueous ammonia, memocarboxylic acids, dicarboxylic acids, and polycarboxylic acids; and aldehydes such as formalin. In addition to such compounds, chelating agents such as inorganic phosphoric acids, aminopolycarboxylic acids, organic phosphonic acids, aminopolyphosphonic acids, and phosphonocarboxylic acids; bactericides such as thiazoles, isothiazoles, halogenated phenols, sulfanylamide and benzotriazole; surfactants; fluorescent brightener; and film hardening agents may also be added to the washing water. Two or more of them may be used in combination, for the same or different purposes.

In view of improvement of image preservability, it is preferred to use any of a variety of ammonium salts such as ammonium chloride, ammonium nitrate, ammonium sulfate, ammonium phosphate, ammonium sulfite and ammonium thiosulfate, as the agent for adjusting pH value of the processing machine.

When the amount of washing water is substantially saved as is explained above, it is preferred, for the purpose of reducing the amount of solution discharged, that all or a part of the overflow of the washing water be introduced into a front bath such as the bleaching-fixing bath or fixing bath.

If the water washing process is continuously carried out, each replenishing solution is added to the corresponding processing bath so as to prevent change in bath composition. This results in the formation of final products having uniform properties. The amount of each replenishing solution may be reduced to half or less of the standard amount thereof for the purposes of, for instance, reducing cost.

According to need, each processing bath may be equipped with a heater, a temperature sensor, a level sensor, a circulation pump, a filter, any of a variety of floating covers, various kinds of squeezes, a nitrogen agitator and an air agitator.

The method according to the present invention can be applied to any processing method so far as the processing method utilizes a color developer. For example, the method can be applied to the processing of color papers, color reversal papers, color positive films, color negative films and color reversal films.

Silver halide emulsion for use in this invention contains silver bromide, silver chlorobromide, or silver chloride each substantially containing no silver iodide. A preferred silver halide is silver chlorobromide containing from 2 mol % to 99 mol % silver chloride.

In the case of performing quick processing and low replenisher processing, a silver chlorobromide emulsion containing at least 60 mol % silver chloride or a silver chloride emulsion is preferred, and those containing from 80 mol % to 100 mol % of silver chloride are particularly preferred. Also, in the case of requiring high sensitivity and restraining the formation of fog as low as possible during the production, storage and/or processing of color photographic material, a silver chlorobromide emulsion or an iodobromide emulsion each containing at least 50 mol % silver bromide or a silver bromide emulsion is preferred and also it is more preferred that the content of silver bromide is higher than 70 mol %. When the content of silver bromide is over 90 mol %, it becomes difficult to effectively perform quick processing for the color photographic materials but by employing a development accelerating means of using a development accelerator such as a silver halide solvent, a fogging agent, a developing agent, etc., as will be described hereinafter, the development process can be quickened to some extent without being restricted by the content of silver bromide and such a case is sometimes preferred.

The silver halide grains for use in this invention may have a regular crystal form such as cubic, octahedral, dodecahedral, tetradecahedral, etc., a mixture thereof, an irregular crystal form such as spherical, etc., or a composite form of these crystal forms. Also, the silver halide grains may be tabular grains and in this case, a tabular grain silver halide emulsion wherein tabular silver halide grains having an aspect ratio (length/thickness) of at least 5 (that is, at least 5/1), and preferably at least 8, account for at least 50% of the total projected area of the silver halide grains can be used in this invention. A mixture of these silver halide emulsions each containing silver halide grains having different crystal form may also be used The silver halide emulsion may be of a surface latent image type of forming latent images mainly on the surface thereof or of an internal latent image type of forming latent images mainly in the inside of the grains.

The silver halide grains for use in this invention may have different phase between the inside and the surface layer thereof, may be a multiphase structure having a junction structure, or may be composed of a uniform phase throughout the whole grain Also, the silver halide grains may be composed of a mixture thereof The mean grain size (shown by the diameter of the grains when the grain is spherical or similar to spherical, and shown by the mean value based on the projected area using, in the case of cubic grains, the long side length as the grain size, or shown by the mean value calculated as a sphere in the case of tabular grains) of the silver halide grains for use in this invention is preferably in the range of from 0.1 μm to 2 μm, more preferably from 0.15 μm to 1 μm. The grain size distribution of the silver halide grains may be narrow or broad but the use of a so-called monodisperse silver halide emulsion, wherein the value (coefficient of variation) obtained by dividing the standard deviation in the grain size distribution curve of the silver halide emulsion by the mean grain size of the silver halide grains in the emulsion is within 20% (preferably within 15%), is preferred. Also, for satisfying the desired gradation for the color photographic material, two or more kinds of monodisperse silver halide emulsions (preferably having the above-described coefficient of variation) each having different grain size can be used as a mixture thereof for one emulsion layer or as separate emulsion layers each having substantially the same color sensitivity. Furthermore, two or more kinds of polydisperse silver halide emulsion layers or a combination of the monodisperse silver halide emulsion and a polydisperse silver halide emulsion can be used as a mixture thereof for one emulsion layer or as separate emulsion layers.

The silver halide photographic emulsions for use in this invention can be prepared according to the methods described in P. Glafkides, *Chimie et Physique Photographique*, published by Paul Montel, 1967; G. F. Duffin, *Photographic Emulsion Chemistry*, published by Focal Press, 1966; and V. L. Zelikman et al., *Making and Coating Photographic Emulsion*, published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the existence of excess silver ions can also be used. As one system of the double jet method, a so-called controlled double jet method of keeping a constant pAg in a liquid phase of forming silver halide grains can also be used. According to the method, a silver halide emulsion containing silver halide grains having a regular crystal form and substantially uniform grain sizes can be obtained.

Furthermore, a silver halide emulsion prepared by a conversion method including a step of converting a silver halide already formed before finishing the formation of the silver halide grains into a silver halide having small solubility product or a silver halide emulsion to which the similar halogen conversion was applied after finishing the formation of the silver halide grains can also be used in this invention.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

Silver halide emulsions are, after the formation of the silver halide grains, usually physically ripened, desalted, and chemically ripened before coating.

A silver halide solvent (e.g., ammonia, potassium rhodanate, and thioethers and thione compounds described in U.S. Pat. No. 3,271,157, Japanese Patent Application (OPI) Nos. 360/76, 82408/78, 144319/78, 100717/79, 155828/79, etc.) can be used for the precipitation, physical ripening, and chemical ripening of the silver halide emulsions for use in this invention.

For removing soluble salts from silver halide emulsions after physical ripening, a noodle washing method, a flocculation method, or an ultrafiltration method can be employed.

The silver halide emulsions for use in this invention can be chemically sensitized by a sulfur sensitization method using active gelatin or a sulfur-containing compound capable of reacting with gelatin (e.g., thiosulfates, thiourea, mercapto compounds, rhodanines, etc.); a reduction sensitization method using a reducing material (e.g., stannous salts, amines, hydrazine derivatives, formamidinesulfinic acid, silane compounds, etc.); a noble metal sensitization method using a metal compound (e.g., gold complex salts and complex salts of metals belonging to group VIII of the Periodic Table, such as Pt, Ir, Pd, Rh, Fe, etc.), or a combination thereof The silver halide emulsion for use in this invention are spectrally sensitized by methine dyes, etc., so that the emulsions have desired color sensitivities, i.e., blue sensitivity, green sensitivity, and red sensitivity. The dyes for use include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes, and complex merocyanine dyes.

For these dyes can be applied nuclei ordinarily utilized for cyanine dyes as basic heterocyclic nuclei. That is, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an aliphatic hydrocarbon ring to the aforesaid nuclei, and the nuclei formed by fusing an aromatic hydrocarbon ring to the aforesaid nuclei, such as indolenic nuclei, benzindolenine nulei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied for the dyes described above. These nuclei may be substituted on carbon atoms.

For mercyanine dyes or complex merocyanine dyes may be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as a nucleus having a ketomethylene structure.

These sensitizing dyes may be used singly or as a combination thereof. A combination of sensitizing dyes is frequently used for the purpose of super-color-sensitization. Typical examples of the combinations are described in U.S. Pat. Nos. 2,688,545, 2,977,229, 3,390,067, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent Publications Nos. 4963/68 and 12375/78, Japanese Patent Application (OPI) Nos. 110618/77, 109925/77, etc.

The silver halide emulsion for use in this invention may contain a dye having no spectral sensitizing activity by itself or a material which does not substantially absorb visible light and shows super-color-sensitizing activity together with the sensitizing dye(s).

The sensitizing dye(s) may be added to a silver halide emulsion in any step during the formation or silver halide grains, before or after the chemical sensitization, during the chemical sensitization, or coating. The addition of the sensitizing dye(s) during the formation of silver halide grains is effective not only for the increase of adsorption thereof but also for the control of the crystal form and the structure in the grains. Also, the addition of the sensitizing dye(s) at the chemical sensitization is effective not only for the increase of the adsorption thereof but also for the control of the chemical sensitizing site and the prevention of the deformation of crystals. Such an addition method is particularly effective in the case of using silver halide emulsions having a high content of silver chloride and also in the case of using silver halide emulsions having high silver bromide content at the surface of the silver halide grains.

Color photographic materials for use in this invention contain color couplers in the silver halide emulsion layers. It is preferred that the color couplers are rendered nondiffusible by a ballast group or by being polymerized. Furthermore, the use of 2-equivalent color couplers the coupling active position of which is substituted by a releasing group is more effect for reducing the amount of silver than the case of using 4-equivalent color couplers having a hydrogen atom at the coupling active position thereof. Couplers providing colored dyes having a proper diffusibility, non-coloring couplers, DIR couplers releasing a development inhibitor with the coupling reaction or couplers releasing a development accelerator with the coupling reaction thereof can be used for the color photographic materials.

Typical examples of the yellow couplers for use in this invention are oil-protect type acylacetamide series yellow couplers. Specific examples of the couplers are described in U.S. Pat. Nos. 2,407,210 2,875,057, 3,265,506, etc.

In this invention, 2-equivalent yellow couplers are preferably used and typical examples thereof are oxygen atom-releasing type yellow couplers described in U.S. Pat. Nos. 3,408,194, 3,447,928, 3,933,501, 4,022,620, etc., and nitrogen atom-releasing type yellow couplers described in Japanese Patent Publication No. 10739/83, U.S. Pat. Nos. 4,401,752 and 4,326,024, *Research Disclosure*, RD No. 18053 (April, 1979), British Patent No. 1,425,020 West German Patent Application (OLS) Nos. 2,219,917, 2,261,361, 2,329,587, 2,433,812, etc. In these couplers, α-pivaloylacetanilide series yellow couplers are excellent in fastness, in particular, light fastness of the colored dyes formed, while α-benzoylacetanilide series yellow couplers give high coloring density.

As the magenta couplers for use in this invention, there are oil-protect type indazolone series or cyanoacetyl series magenta couplers, preferably 5-pyrazolone series couplers and pyrazoloazole series couplers such as pyrazolotriazole series couplers.

The pyrazolone series couplers having an arylamino group or an acylamino group at the 3-position thereof are preferred from the viewpoint of the hue of the colored dyes and the coloring density and typical examples of the couplers are described in U.S. Pat. Nos. 2,311,082, 2,343,703, 2,600,788, 2,908,573, 3,062,653, 3,152,896, 3,936,015, etc. Preferred releasing groups for the 2-equivalent 5-pyrazolone series magenta couplers include nitrogen atom-releasing groups described in U.S. Pat. No. 4,310,619 and arylthio groups described in U.S. Pat. No. 4,351,897. Also, 5-pyrazolone series magenta couplers having a ballast group described in European Patent 73,636 give high coloring density.

Pyrazoloazole series magenta couplers include pyrazolobenzimidazoles described in U.S. Pat. No. 3,369,879, preferably pyrazolo(5,1-c)(1,2,4)triazoles described in U.S. Pat. No. 3,725,067, pyrazolotetrazoles described in *Research Disclosure*, RD No. 24220 (Juee, 1984), and pyrazolopyrazoles described in ibid., RD No. 24230 (June, 1984). From the viewpoint of less yellow side absorption of colored dyes and high light fastness of colored dyes, imidazo(1,2-b)pyrazoles described in European Patent 119,741 are preferred and pyrazolo(1,5-b)(1,2,4)triazoles described in European Patent 119,860 are particularly preferred.

Cyan couplers for use in this invention include oil-protect type naphtholic and phenolic couplers.

The naphtholic cyan couplers include naphtholic couplers described in U.S. Pat. No. 2,474,293 and, preferably oxygen atom-releasing type 2-equivalent naphtholic couplers described in U.S. Pat. Nos. 4,052,212, 4,146,396, 4,228,233 and 4,296,200. Also, specific examples of the phenolic cyan couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group of two or more carbon atoms at the metaposition of the phenol nucleus described in U.S. Pat. No. 3,772,002, 2,5-diacylamino-substituted phenolic cyan couplers described in U.S. Pat. Nos. 2,772,162, 3,758,308, 4,126,396, 4,334,011 and 4,327,173, West German Patent Application (OLS) No. 3,329,729, Japanese Patent Application (OPI) No. 166956/84, etc., and phenolic cyan couplers having a phenylureido group at the 2-position and an acylamino group at the 5-position thereof described in U.S. Pat. Nos. 3,446,622, 4,333,999, 4,451,559, 4,427,767, etc.

In this invention, the graininess of the color images formed can be improved by using a coupler giving colored dye having a proper diffusibility together with the aforesaid coupler(s). About such couplers giving diffusible dyes, specific examples of the magenta couplers are described in U.S. Pat. No. 4,366,237 and British Patent No. 2,125,570 and specific examples of the yellow, magenta, and cyan couplers are described in European Patent No. 96,570 and West German Patent Application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Patent No. 2,102,173 and U.S. Pat. No. 4,367,282.

The couplers for use in this invention can be used for one light-sensitive emulsion layer as a mixture of two or more for meeting the properties required for the color photographic material or the same kind of coupler may be incorporated to two or more photographic layers.

The couplers for use in this invention can be introduced into silver halide emulsions by an oil drop-in-water dispersion method. That is, the coupler is dissolved in a high boiling organic solvent having boiling point of at least 175° C. or a low boiling so-called auxiliary solvent, or a mixture of both types of solvents, and then finely dispersed a water or an aqueous medium such as an aqueous gelatin solution in the presence of a surface active agent. Examples of the high boiling organic solvent are described in U.S. Pat. No. 2,322,027, etc. In this case, the coupler may be dispersed with phase inversion and also, if necessary, the auxiliary solvent may be removed by distillation, noodle washing, or ultrafiltration before coating the dispersion.

Specific examples of the high boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecyl-benzene, diisopropylnaphthalene, etc.), etc.

As the auxiliary solvent, organic solvents having boiling point of at least about 30° C., preferably from about 50° C. to about 160° C. can be used, and specific examples thereof are ethyl acetate, butyl acetate, ethyl propionate, methyl ethyl ketone, cyclohexanone, 2-ethoxy-ethyl acetate, dimethylformamide, etc.

A latex dispersing method can also be applied for incorporating the coupler into silver halide emulsions. The process and effect of the latex dispersing method and specific examples of the latex for impregnation are described in U.S. Pat. No. 4,199,363, West German Patent Application (OLS) Nos. 2,541,274, 2,541,230, etc.

A standard amount of the color coupler is in the range of from 0.001 mol to 1 mol per mol of the light-sensitive silver halide in the silver halide emulsion layer, with from 0.01 mol to 0.5 mol of a yellow coupler, from 0.003 mol to 0.3 mol of a magenta coupler, and from 0.002 mol to 0.3 mol of a cyan coupler, per mol of the light-sensitive silver halide being preferred.

The color photographic materials for use in this invention may further contain hydroquinone derivatives aminophenol derivatives, amines, gallic acid derivatives, catechol derivatives, ascorbic acid derivatives, non-coloring couplers, sulfonamidophenol derivatives, etc., as color fog preventing agents or color mixing preventing agent.

Also, the color photographic materials for use in this invention can further contain fading preventing agents. Typical examples of organic fading preventing agents are hydroquinones, 6-hydroxychromans, 5-hydroxycoumarans, spirochromans, p-alkoxyphenols, bisphenols, hindered phenols, gallic acid derivatives, methylene-dioxybenzenes, aminophenols, hindered amines and the ether or ester derivatives of the aforesaid compounds obtained by silylating or alkylating the phenolic hydroxy group of these compounds. Also, metal complexes such as (bissalicylaldoxymate) nickel complex salt and (bis-N,N-dialkyldithiocarbamate) nickel complex salt can also be used as the fading preventing agent.

For preventing the deterioration of yellow dye images by heat, moisture, and light, the compound having both moieties of hindered amine and hindered phenol in one molecule as described in U.S. Pat. No. 4,268,593 gives good results. Also, for preventing the deterioration of magenta dye images, particularly by light, spiroindans described in Japanese Patent Application (OPI) No. 159644/81 and chromans substituted by hydroquinone diether or hydroquinone monoether described in Japanese Patent Application (OPI) No. 89835/80 give preferred results.

For improving the stability or storability, in particular, the light fastness of cyan dye images, it is preferred to use a benzotriazole series ultraviolet absorbent with the cyan coupler(s). The ultraviolet absorbent may be co-emulsified with the cyan coupler(s). The amount of the ultraviolet absorbent is desirably sufficient for imparting light stability to cyan dye images, but since if the amount is too much, the unexposed portions (background portions) of the color photographic material are sometimes yellowed, the amount thereof is usually selected in the range of from $1\times10^{-4}$ mol/m$^2$ to $2\times10^{-3}$ mol/m$^2$, particularly from $5\times10^{-4}$ mol/m$^2$ to $1.5\times10^{-3}$ mol/m$^2$.

In the layer structure of an ordinary color photographic paper, the ultraviolet absorbent(s) are incorporated in one or both layers adjacent to both sides of a red-sensitive silver halide emulsion layer containing cyan coupler. When the ultraviolet absorbent(s) are incorporated in the interlayer between a green-sensitive emulsion layer and a red-sensitive emulsion layer, the ultraviolet absorbent(s) may be emulsified together with a color mixing preventing agent. When the ultraviolet absorbent(s) are incorporated in a protective layer, another protective layer may be formed on the protective layer as the outermost layer. The outermost protective layer may contain a matting agent having a proper particle size.

The color photographic materials may further contain water-soluble dyes in the hydrophilic colloid layers as filter dyes or for the purpose of irradiation prevention or halation prevention.

As such water-soluble dyes, oxonol series dyes, anthraquinone series dyes, and azo series dyes are preferred. Oxonol dyes showing absorptions for green light and red light are particularly preferred.

The color photographic materials for use in this invention may further contain whitening agents such as stilbene series, triazine series, oxazole series, or coumarin series whitening agents in the photographic emulsion layers or other hydrophilic colloid layers. The whitening agent may be water-soluble or a water-insoluble whitening agent may be used as the form of the dispersion.

The process of this invention can be applied to a multilayer multicolor photographic material having at least two photographic emulsion layers each having different spectral sensitivity on a support. A multilayer natural color photographic material usually has at least one red-sensitive emulsion layer, at least one green-sensitive emulsion layer, and at least one blue-sensitive emulsion layer on a support. The disposition order of the emulsion layers can be optionally selected according to the purposes Also, each of the aforesaid emulsion layers may be composed of two or more emulsion layers each having different light sensitivity or a light-insensitive layer may exist between two or more emulsion layers each having the same sensitivity.

The color photographic material for use in this invention preferably has auxiliary layers such as protective layer(s), interlayers, a filter layer, an antihalation layer, a back layer, etc., in addition to the silver halide emulsion layers.

As a binder or protective colloid which can be used for the emulsion layers and auxiliary layers of the color photographic material for use in this invention, gelatin is advantageously used but other hydrophilic colloids can be used.

Examples of the protective colloid are proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; saccharose derivatives such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The use of acrylic acid-modified polyvinyl alcohol is useful for protective layer and further is particularly useful in the case of quick processing color photographic material using high silver chloride containing silver halide emulsions.

As gelatin, limed gelatin as well as acid-treated gelatin and enzyme-treated gelatin as described in *Bull. Soc. Sci. Phot. Japan*, No. 16, p. 30 (1966) can be used. Furthermore, the hydrolyzed product or enzyme-decomposed product of gelatin can be used.

The color photographic materials for use in this invention may further contain various stabilizers, stain preventing agents, developing agents or the precursors therefor, development accelerators described hereinbefore or the precursors therefor, lubricants, mordants, matting agents, antistatic agents, plasticizers, or other photographically useful additives in addition to the above-described additives. Typical examples of such additives are described in *Research Disclosure*, RD No. 17643 (December, 1978) and ibid., RD No. 18716 (November, 1979).

The effects attained by the method of this invention will hereunder be explained with reference to the following Examples.

EXAMPLE 1

On a paper support, both surfaces of which were laminated with polyethylene films, a multi-layer color photographic paper was formed. Each layer of the color photographic paper was obtained by applying the following coating solutions, in a desired order, which were prepared as follows:

Preparation of the coating solution for the first layer:

To 19.1 g of yellow coupler (a) and 4.4 g of dye image stabilizer (b), there were added 27.2 ml of ethyl acetate and 7.9 ml of solvent (c) to form a solution and the resultant solution was dispersed and emulsified in 185 ml of 10% gelatin aqueous solution containing 8 ml of sodium dodecylbenzenesulfonate. On the other hand, the following blue-sensitive dye was added to a silver chlorobromide emulsion (silver bromide content: 4 mol %; silver content: 70 g/kg emulsion) in an amount of $5.0\times10^{-4}$ mole per mole of silver chlorobromide and thus 90 g of a blue-sensitive emulsion was obtained. Then, the foregoing emulsified dispersion was admixed with and dissolved in the blue-sensitive emulsion separately prepared above while adjusting the gelatin concentration thereof so as to attain the composition shown in Table A and thus a coating solution for the first layer was prepared. Coating solutions for the remaining second to seventh layers were prepared according to procedures similar to those described above. Sodium salt of 1-oxy-3,5-dichloro-s-triazine was used in each layer as the gelatin hardening agent.

The following spectral sensitizing dyes were used in each corresponding emulsion:

Blue-Sensitive Emulsion Layer

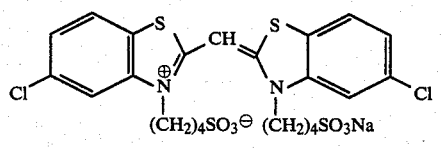

This dye was added in an amount of $5.0\times10^{-4}$ moles per mole of silver halide.)

Green-Sensitive Emulsion Layer

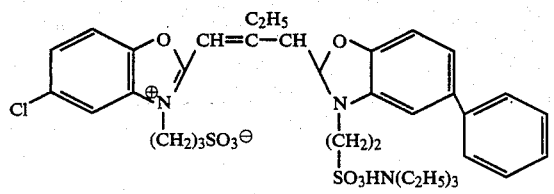

(The dye was added in an amount of $4.0\times10^{-4}$ moles per mole of silver halide.)

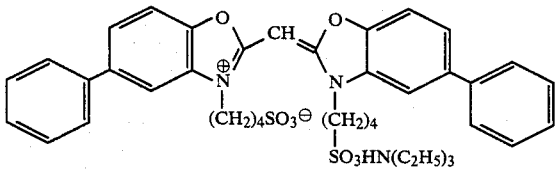

(The dye was used in an amount of $7.0\times10^{-5}$ moles per mole of silver halide.)

Red-Sensitive Emulsion Layer

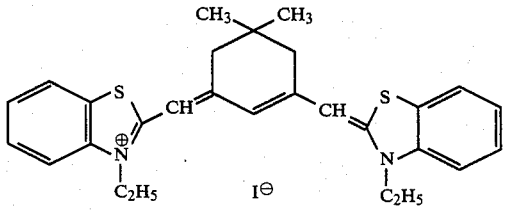

(This dye was used in an amount of $1.0\times10^{-4}$ moles per mole of silver halide.)

As the anti-irradiation dye in each emulsion layer, the following dyes were used, respectively.

Green-Sensitive Emulsion Layer

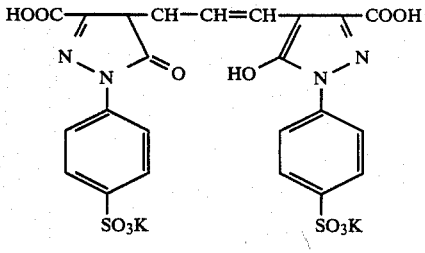

Red-Sensitive Emulsion Layer

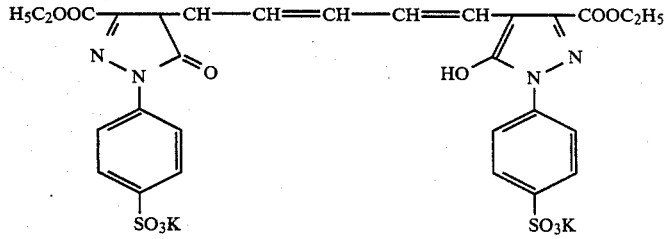

Compounds such as couplers as used in the Example have the following structures, respectively:

(a) Yellow Coupler

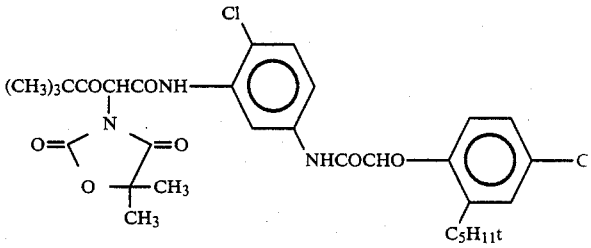

Dye Image Stabilizer

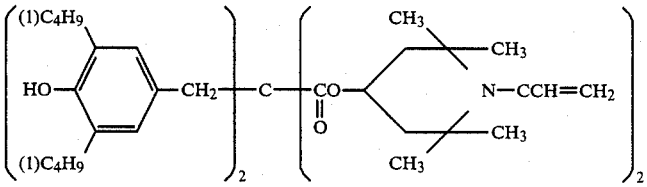

(c) Solvent

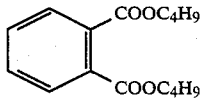

(d)

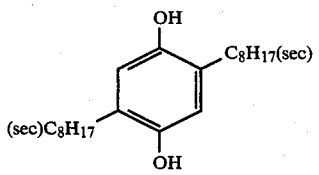

(e) Magenta Coupler (M-53)

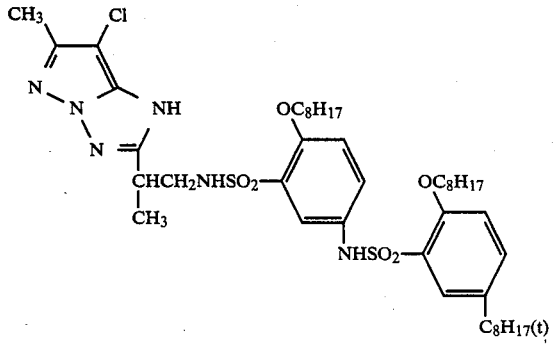

(f) Dye Image Stabilizer

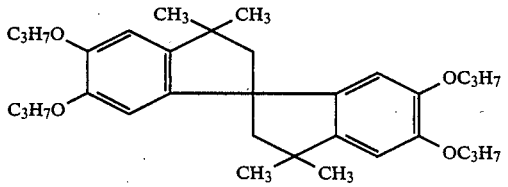

(g) Solvent

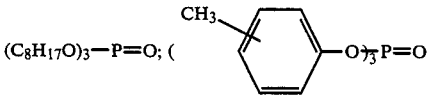

(2:1 (weight ratio) mixture of these two compounds.)

(h) Ultraviolet Light Absorber

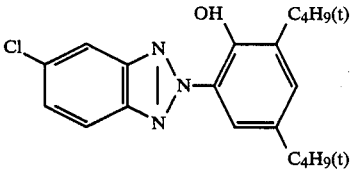

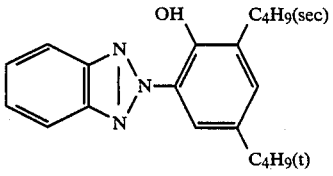

-continued

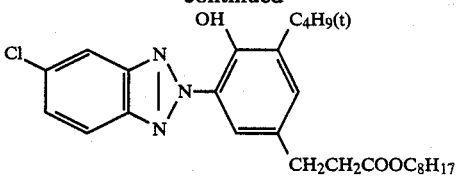

(1:5:3 (molar ratio) mixture of these three compounds.)

(i) Color Mixing Resistant Agent

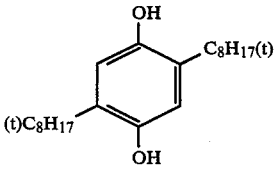

(j) Solvent (iso $C_9H_{13}O)_3$ P=0

(k) Cyan Coupler

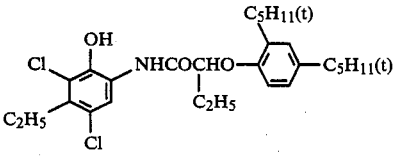

($k_1$)

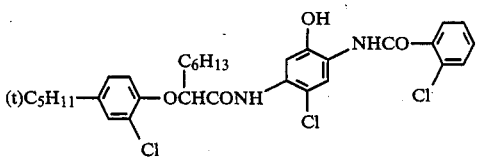

($k_2$)

(1:1 (molar ratio) mixture of these two compounds ($k_1$) and ($k_2$).)

(l) Dye Image Stabilizer

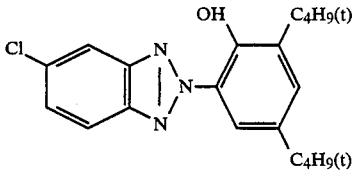

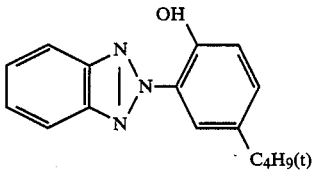

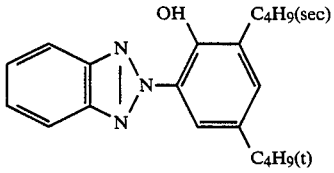

(1:3:3 (molar ratio) mixture of these three compounds.)

(m) Solvent

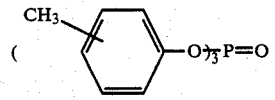

TABLE A

| Layer | Principal Composition | Amount Used |
|---|---|---|
| 7th Layer (Protective Layer) | o Gelatin | 1.33 g/m$^2$ |
| | o Copolymer of Polyvinyl Alcohol Modified with Acryl (Degree of Modification: 17%) | 0.17 g/m$^2$ |
| 6th Layer (UV Light Absorbing Layer) | o Gelatin | 0.54 g/m$^2$ |
| | o UV Light Absorber (h) | 0.21 g/m$^2$ |
| | o Solvent (j) | 0.09 cc/m$^2$ |
| 5th Layer (Red-Sensitive Layer) | o Silver Chlorobromide Emulsion (Content of Silver Bromide: 4 mole %); Silver: | 0.26 g/m$^2$ |
| | o Gelatin | 0.98 g/m$^2$ |
| | o Cyan Coupler (k) | 0.38 g/m$^2$ |
| | o Dye Image Stabilizer (1) | 0.17 g/m$^2$ |
| | o Solvent (m) | 0.23 cc/m$^2$ |
| 4th Layer (UV Light Absorbing Layer) | o Gelatin | 1.60 g/m$^2$ |
| | o UV Light Absorber (h) | 0.62 g/m$^2$ |
| | o Color Mixing Resistant Agent (i) | 0.05 g/m$^2$ |
| | o Solvent (j) | 0.26 cc/m$^2$ |
| 3rd Layer (Green-Sensitive Layer) | o Silver Chlorobromide Emulsion (Content of AgBr: 10 mole %); Silver: | 0.16 g/m$^2$ |
| | o Gelatin | 1.80 g/m$^2$ |
| | o Magenta Coupler (e) | 0.34 g/m$^2$ |
| | o Dye Image Stabilizer (f) | 0.20 g/m$^2$ |
| | o Solvent (g) | 0.68 cc/m$^2$ |
| 2nd Layer (Color Mixing Resistant Layer) | o Gelatin | 0.99 g/m$^2$ |
| | o Color Mixing Resistant Agent (d) | 0.08 g/m$^2$ |
| 1st Layer (Blue-Sensitive Layer) | o Silver Chlorobromide Emulsion (Content of AgBr: 10 mole %); Silver: | 0.30 g/m$^2$ |
| | o Gelatin | 1.86 g/m$^2$ |
| | o Yellow Coupler (a) | 0.82 g/m$^2$ |
| | o Dye Image Stabilizer (b) | 0.19 g/m$^2$ |
| | o Solvent (c) | 0.34 cc/m$^2$ |
| Support | Paper Laminated with Polyethylene Film (To the polyethylene film located at the side of the 1st layer, a white pigment ($TiO_2$) and a bluing dye (ultramarine blue) are added.) | |

With the multi-layer color photographic papers obtained according to the process as set forth above, continuous processing of the color photographic papers which had been subjected to imagewise exposure to light were carried out according to the following three different processing methods A to C until the amount of replenishing solution for color development solution (overflow) reached three times the volume of the color development tank.

| Kind of Processing | Processing Time (sec.) A (Comparative Example) | B (Invention) | C (Invention) |
|---|---|---|---|
| Color Development (35° C.) | 45 | 45 | 45 |
| Bleaching-Fixing (35° C.) | 45 | 45 | 45 |
| Rinse 1 (35° C.) | 20 | 20 | 20 |

-continued

| Kind of Processing | Processing Time (sec.) A (Comparative Example) | B (Invention) | C (Invention) |
|---|---|---|---|
| Rinse 2 (35° C.) | 20 | 20 | 20 |
| Rinse 3 (35° C.) | 20 | 20 | 20 |
| Rinse 4 (35° C.) | 30 | 30 | 30 |
| Drying (80° C.) | 60 | 60 | 60 |

*The arrow indicates the flow direction of overflow.

In all the processing methods A to C, the water washing process comprised a four-tank counterflow washing system in which the washing water flowed from a tank for rinse 4 to that for rinse 1. In the processing method B, the overflow from the color development tank was poured into the bleaching-fixing bath. Moreover, the overflow from the color development tank and that from the tank for rinse 1 were introduced into the bleaching-fixing tank or bath in the processing method C.

The replenished amount of each processing solution in the method A was as follows:

| Processing Solution | | Replenished Amount |
|---|---|---|
| Color Development | | 75 ml/m$^2$ |
| Bleaching-Fixing (Solution A) | 25 ml | total amount: 200 ml/m$^2$ |
| Bleaching-Fixing (Solution B) | 25 ml | |
| Water | 150 ml | |
| Rinse | | 100 ml/m$^2$ |

In the method B, 30 ml of the overflow solution from the color development bath, 40 ml of the color development solution entrained with the treated color photographic paper (70 ml/m$^2$ in total) and 80 ml/m$^2$ of water were used as the diluent for the replenishing solutions (A and B) of the bleaching-fixing bath, while in the method C, all the overflow from the color development bath and all the overflow (about 80 ml/m$^2$) from the tank for rinse 1 were used as the diluent for the replenishing solutions of the bleaching-fixing bath.

The composition of each processing solution used in Example 1 was as follows:

| Color Development Solution | Solution contained in Tank | Replenishing Solution |
|---|---|---|
| Water | 800 ml | 800 ml |
| 60% Solution of 1-hydroxyethylidene-1,1-diphosphonic acid | 1.5 ml | 1.5 ml |
| Lithium chloride | 1.0 g | 1.0 g |
| Diethylenetriaminepentaacetic acid | 1 g | 1 g |
| 4,5-Dihydroxy-m-benzenedisulfonic acid | 1.0 g | 1.5 g |
| Sodium sulfite | 0.5 g | 1.0 g |
| Potassium bromide | 0.1 g | — |
| Sodium chloride | 1.5 g | — |
| Adenine | 30 mg | 60 mg |
| Potassium carbonate | 40 g | 40 g |
| N—ethyl-N—(β-methanesulfonamideethyl)-3-methyl-4-aminoaniline sulfate | 4.5 g | 11.0 g |
| Hydroxylamine sulfate | 3.0 g | 4.0 g |
| Fluorescent Brightener (manufactured and sold by Sumitomo Chemical Company, Limited under the trade name of | 1.0 g | 2.0 g |

-continued

| | | |
|---|---|---|
| Whitex 4) | | |
| Poly(ethyleneimine) (50% aqueous solution) | 3.0 g | 3.0 g |
| Water (the amount required to obtain 1 l of each solution) | | |
| pH (by the addition of KOH) | 10.25 | 10.80 |

| Bleach-Fixing Solution | Solution contained in Tank |
|---|---|
| Water | 400 ml |
| Ammonium thiosulfate (70%) | 150 ml |
| Sodium sulfite | 18 g |
| Iron (III) ammonium ethylenediaminetetraacetate | 55 g |
| Ethylenediaminetetraacetic acid | 5 g |
| Water (the amount required to obtain 1 l of the soluton) | |
| pH | 6.75 |
| Replenishing Solution A for Bleaching-Fixing Solution | |
| Ammonium thiosulfate (70% solution) | 900 ml |
| EDTA.2Na | 20 g |
| Sodium bisulfite | 120 g |
| Aqueous ammonia (26%) | 20 ml |
| Water (the amount required to obtain 1 l of the solution A) | |
| pH (by the addition of aqueous ammonia) | 6.70 |
| Replenishing Solution B for Bleaching-Fixing Solution | |
| Aqueous ammonia (26%) | 20 ml |
| EDTA.4H | 40 g |
| EDTAFe(III) $NH_4.2H_2O$ | 320 g |
| Water (the amount required to obtain 1 l of the solution B) | |
| pH | 4.70 |
| Rinse Solution (The solution for the tank and that for replenishing have the same composition or formulation) | |
| 1-Hydroxyethylidene-1,1-diphosphonic acid (60%) | 1.5 ml |
| Nitrilotriacetic acid | 1.0 g |
| EDTA | 0.5 g |
| N,N,N',N'—tetramethylenephosphonic acid | 1.0 g |
| $BiCl_3$ (40% aqueous solution) | 0.50 g |
| $MgSO_4.7H_2O$ | 0.20 g |
| $ZnSO_4$ | 0.3 g |
| Ammonium alum | 0.5 g |
| 5-Chloro-2-methyl-4-isothiazolin-3-one | 30 mg |
| 2-Methyl-4-isothiazolin-3-one | 10 mg |
| 2-Octyl-4-isothiazolin-3-one | 10 mg |
| Ethylene glycol | 1.5 g |
| Sulfanylamide | 0.1 g |
| 1,2,3-Benzotriazole | 1.0 g |
| Ammonium sulfite (40% aqeuous solution) | 1.0 g |
| Aqueous ammonia (26%) | 2.6 ml |
| Polyvinyl pyrrolidone | 1.0 g |
| Fluorescent Brightener (4,4'-diaminostilbene type) | 1.0 g |
| Water (the amount required to obtain 1 l of the solution) | |
| pH (by the addition of KOH) | 7.0 |

During the running test, the amount of overflow solution discarded from each processing bath and determined. The results obtained were as shown in the following Table 1 in which the amount of overflow discarded is expressed as milliliters per unit area (1 $m^2$) of the color photographic paper treated.

TABLE 1

| Process (Overflow solution) | Method A (Comparative Example) | Method B (Invention) | Method C (Invention) |
|---|---|---|---|
| Color Development | 30 | — | — |
| Bleaching-Fixing | 200 | 200 | 200 |
| Rinse | 80 | 80 | — |
| Total | 310 | 280 | 200 |

According to the method of this invention, the amount of waste liquor can substantially be reduced by using the overflow solution from the color development bath as a part of the water to be used for preparing the replenishing solution of the bleaching-fixing bath, as seen from the results listed in Table 1. Moreover, to examine whether there is a problem regarding the properties of the resultant color photograph, Dmin and Dmax (minimum and maximum density) were measured on samples which were obtained by subjecting the aforementioned light-sensitive material to wedge-shaped exposure The measurement was carried out before and after each processing step with a Macbeth's reflection densitometer. In addition, the yellow stain was also determined on three groups of samples after the completion of the running processing, one group of which was maintained at 100° C. for six days, another group of which was allowed to stand at 60° C. and 70% RH for 60 days and the remaining group of which was maintained for 20 days under the condition of irradiating light (Xenon 83 Lux) and the change in the yellow stain was evaluated. The results obtained are shown in the following Table 2.

TABLE 2

| Matters | Property Measured | Method A (Comparative Example) | Method B (Invention) | Method C (Invention) |
|---|---|---|---|---|
| Values measured at the time of beginning of the running | $D_B$ min | 0.12 | 0.12 | 0.12 |
| | $D_G$ min | 0.07 | 0.07 | 0.07 |
| | $D_R$ min | 0.07 | 0.07 | 0.07 |
| | $D_B$ max | 2.13 | 2.12 | 2.14 |
| | $D_G$ max | 2.65 | 2.63 | 2.65 |
| | $D_R$ max | 2.45 | 2.44 | 2.46 |
| Values observed at the time of completion of the running | $D_B$ min | 0.13 | 0.13 | 0.13 |
| | $D_G$ min | 0.08 | 0.08 | 0.08 |
| | $D_R$ min | 0.08 | 0.08 | 0.08 |
| | $D_B$ max | 2.10 | 2.12 | 2.12 |
| | $D_G$ max | 2.63 | 2.64 | 2.65 |
| | $D_R$ max | 2.40 | 2.43 | 2.43 |
| Change in yellow stain with time | 100° C. | +0.18 | +0.19 | +0.19 |
| | 60° C./70% RH | +0.14 | +0.15 | +0.14 |
| | Xenon | +0.21 | +0.20 | +0.20 |

As will be seen from the above-mentioned results, the method of this invention (Methods B and C) makes it possible to reduce the amount of the waste liquor without impairing the photographic properties of the light-sensitive material treated.

EXAMPLE 2

Samples 101 to 103 of multi-layer color light-sensitive material were produced by forming layers, each of which had the following composition, on a support made of cellulose triacetate film having an undercoat layer.

(Composition of the light-sensitive layer)

In the following formulation, the coated amount is expressed as follows:

| | |
|---|---|
| Silver halide and colloidal silver | g/m$^2$ |
| Coupler, additives, gelatin | g/m$^2$ |
| Sensitizing dye | moles per mole of the silver halide present in the same layer |
| 1st Layer (antihalation layer) | |
| Black colloidal silver | 0.4 |
| Gelatin | 1.3 |
| Colored coupler C-1 | 0.06 |
| UV light absorber UV-1 | 0.1 |
| UV light absorber UV-2 | 0.2 |
| Dispersion oil Oil-1 | 0.01 |
| Dispersion oil Oil-2 | 0.01 |
| 2nd Layer (intermediate layer) | |
| Finely divided silver bromide (average particle size: 0.07 μ) | 0.15 |
| Gelatin | 0.1 |
| Colored coupler C-2 | 0.02 |
| Dispersion oil Oil-1 | 0.1 |
| 3rd Layer (first red-sensitive emulsion layer) | |
| Silver iodobromide emulsion (AgI = 6 mole %; diameter/thickness ratio = 2.5; average particle size = 0.3 μ) | 15 (silver) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |
| 4th Layer (second red-sensitive emulsion layer) | |
| Silver iodobromide emulsion (AgI content: 6 mole %; diameter/thickness ratio = 3.5; average particle size = 0.5 μ) | 1.5 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |
| 5th Layer (third red-sensitive emulsion layer) | |
| Silver iodobromide emulsion (AgI content = 10 mole %; diameter/thickness ratio = 1.5; average particle size = 0.7 μ) | 2.0 (silver) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-6 | 0.05 |
| Coupler C-7 | 0.1 |
| Dispersion oil Oil-1 | 0.01 |
| Dispersion oil Oil-2 | 0.05 |
| 6th Layer (intermediate layer) | |
| Gelatin | 1.0 |
| Compound Cpd-A | 0.03 |
| Dispersion oil Oil-1 | 0.05 |
| 7th Layer (first green-sensitive emulsion layer) | |
| Silver iodobromide emulsion (content of silver iodide = 6 mole %; diameter/thickness ratio = 2.5; average particle size = 0.3 μ) | 0.7 |

-continued

| | |
|---|---|
| Sensitizing dye IV | $5 \times 10^{-4}$ |
| Sensitizing dye VI | $0.3 \times 10^{-4}$ |
| Sensitizing dye V | $2 \times 10^{-4}$ |
| Gelatin | 1.0 |
| Coupler C-9 | 0.2 |
| Coupler C-5 | 0.03 |
| Coupler C-1 | 0.03 |
| Dispersion oil Oil-1 | 0.5 |
| 8th Layer (second green-sensitive emulsion layer) | |
| Silver iodobromide emulsion (content of silver iodide = 5 mole %; diameter/thickness ratio = 3.5; average particle size = 0.5 μ) | 1.4 |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersion oil Oil-1 | 0.2 |
| 9th Layer (third green-sensitive emulsion layer) | |
| Silver iodobromide emulsion (content of silver iodide = 10 mole %; diameter/thickness ratio = 1.5; average particle size = 0.7 μ) | 1.9 |
| Gelatin | 1.0 |
| Sensitizing dye VII | $3.5 \times 10^{-4}$ |
| Sensitizing dye VIII | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersion oil Oil-1 | 0.20 |
| Dispersion oil Oil-2 | 0.05 |
| 10th Layer (yellow filter layer) | |
| Gelatin | 1.2 |
| Yellow colloidal silver | 0.16 |
| Compound Cpd-B | 0.1 |
| Dispersion oil Oil-1 | 0.3 |
| 11th Layer (first blue-sensitive emulsion layer) | |
| Monodisperse silver iodobromide emulsion (content of silver iodide = 6 mole %; diameter/thickness ratio = 1.5; average particle size = 0.3 μ) | 1.0 (silver) |
| Gelatin | 1.0 |
| Sensitizing dye IX | $2 \times 10^{-4}$ |
| Coupler C-14 | 0.9 |
| Coupler C-5 | 0.07 |
| Dispersion oil Oil-1 | 0.2 |
| 12th Layer (second blue-sensitive emulsion layer) | |
| Silver iodobromide emulsion (content of silver iodide = 10 mole %; diameter/thickness ratio = 1.5; average particle size = 1.5 μ) | 0.9 (silver) |
| Gelatin | 0.6 |
| Sensitizing dye IX | $1 \times 10^{-4}$ |
| Coupler C-14 | 0.25 |
| Dispersion oil Oil-1 | 0.07 |
| 13th Layer (first protective layer) | |
| Gelatin | 0.8 |
| UV light absorber UV-1 | 0.1 |
| UV light absorber UV-2 | 0.2 |
| Dispersion oil Oil-1 | 0.01 |
| Dispersion oil Oil-2 | 0.01 |
| 14th Layer (second protective layer) | |
| Finely divided silver bromide (average particle size = 0.07 μ) | 0.5 |
| Gelatin | 0.45 |
| Particles of polymethylmethacrylate (diameter = 1.5 μ) | 0.2 |
| Film hardening agent H-1 | 0.4 |
| Formaldehyde scavenger S-1 | 0.5 |
| Formaldehyde scavenger S-2 | 0.5 |

To each layer, a surfactant was added as a coating aid in addition to the aforementioned components The sample thus obtained was referred t as Sample 101.

The chemical structural formula or name of each compound used in this Example is as follows:

UV-1
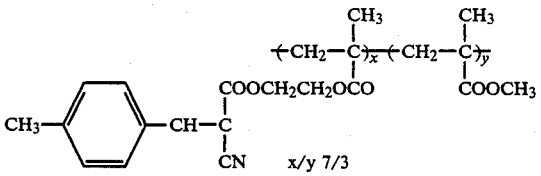
x/y 7/3
(weight ratio)
UV-2
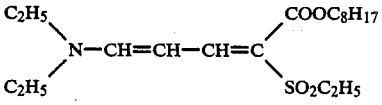
tricresyl phosphate — Oil-1
dibutyl phthalate — Oil 2
bis(2-ethylhexyl)phthalate — Oil-3
C-1
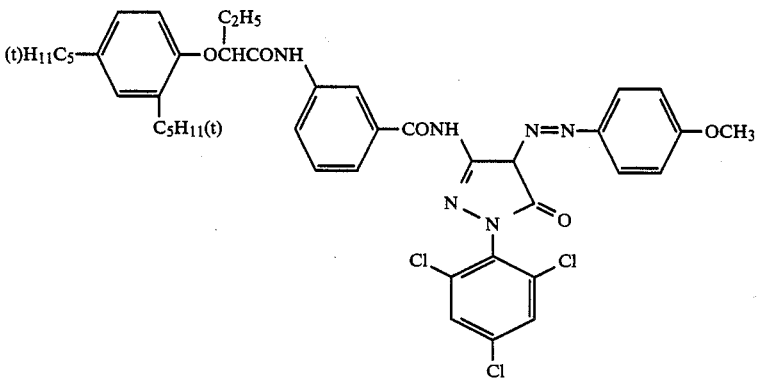
C-2
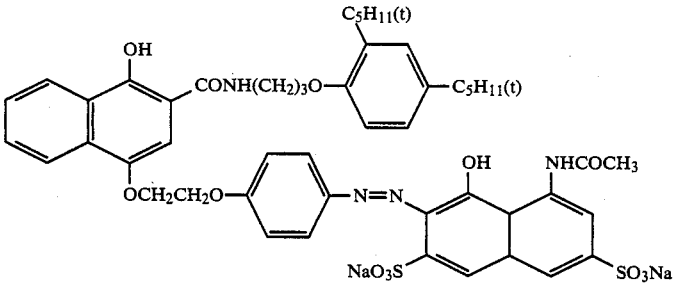
C-3
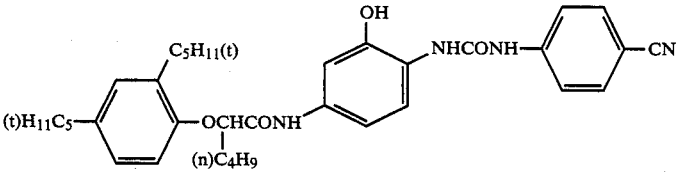
C-4
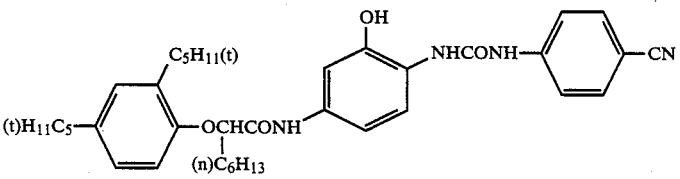

-continued
C-5
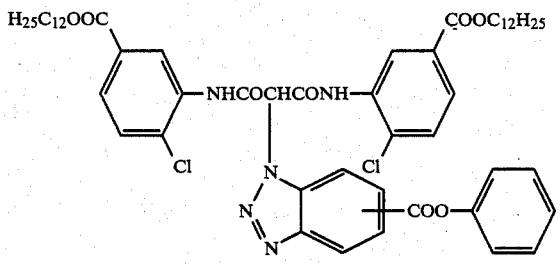
C-15
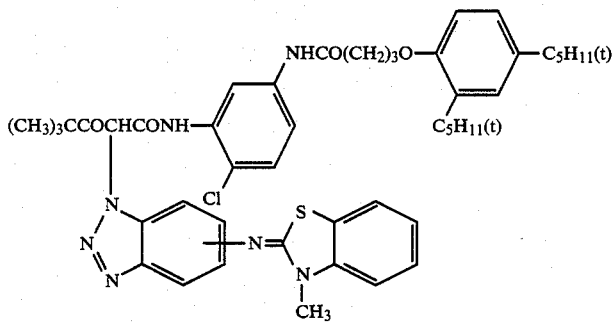
C-6
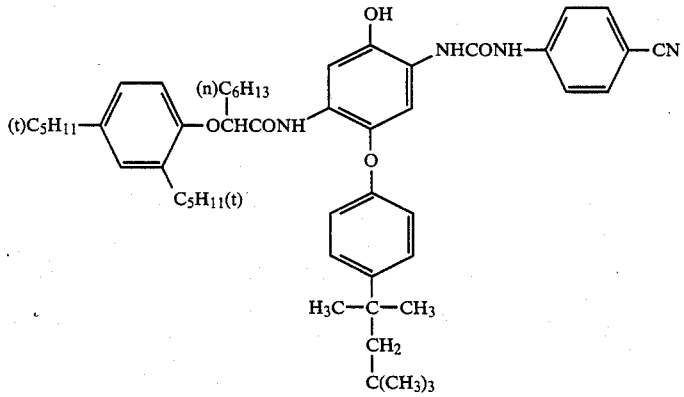
C-7
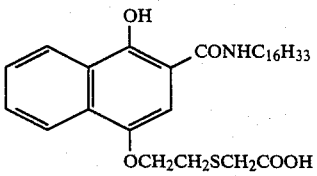
C-8
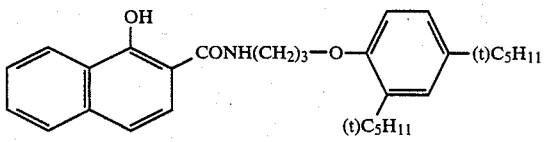

-continued
C-9
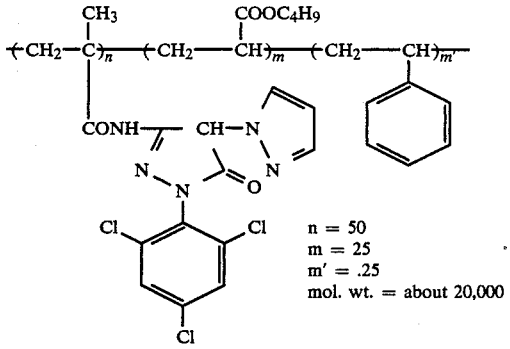
C-10
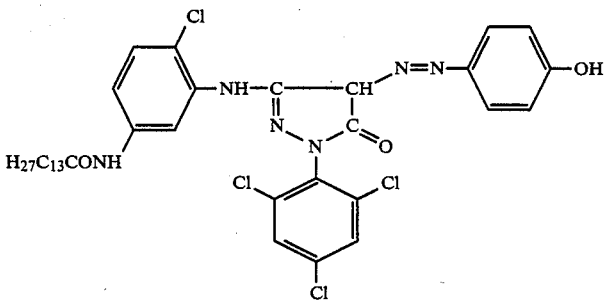
C-11
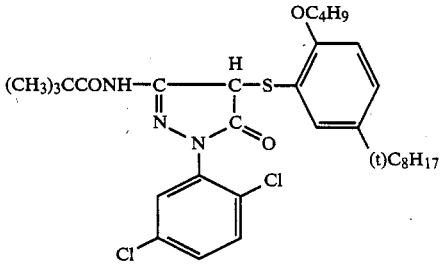
C-12
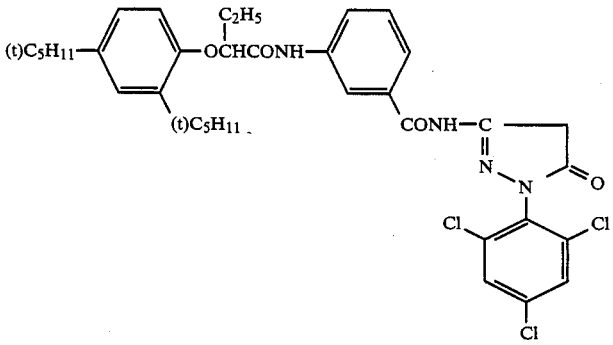
Sensitizing dye I
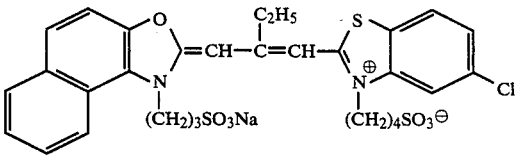

-continued

Sensitizing dye II

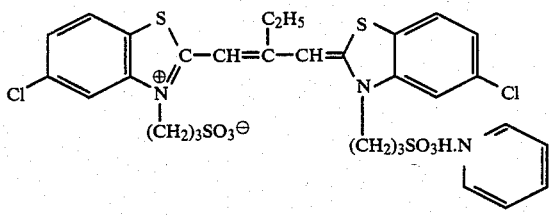

Sensitizing dye III

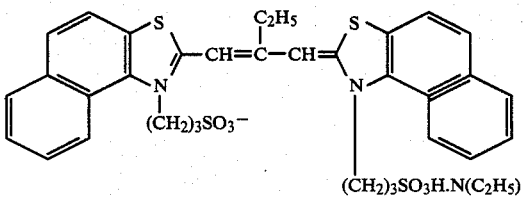

Sensitizing dye IV

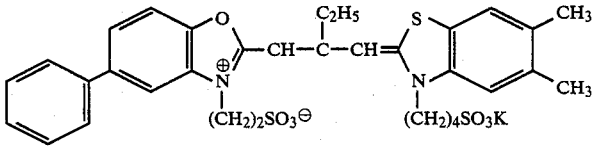

Sensitizing dye VII

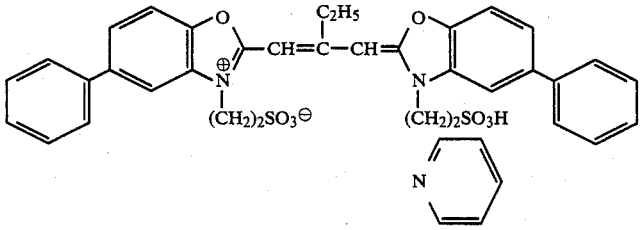

Sensitizing VIII

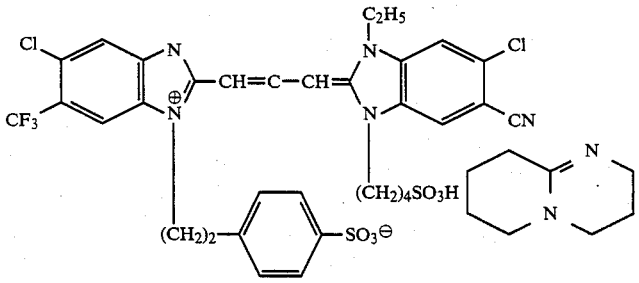

S-2

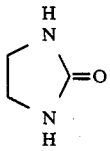

H-1

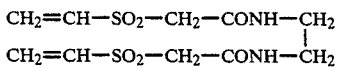

S-1

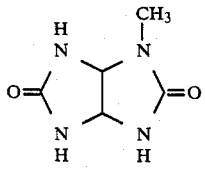

Color light-sensitive materials (width: 35 mm) thus prepared were subjected to imagewise exposure to light and then on these color light-sensitive materials, running tests were carried out according to the following three processing methods D to F till the amount of the replenishing solution for color development solution reached three times the volume of the color development tank.

| Process | D (Comparative Example) | E (Invention) | F (Invention) |
|---|---|---|---|
| Color development (42° C.) | 3 min. 15 sec. | 3 min. 15 sec. | 3 min. 15 sec. |
| Bleaching (38° C.) | 1 min | 1 min. | 1 min. |
| Bleaching-Fixing (38° C.) | 3 min. 15 sec. | 3 min. 15 sec. | 3 min. 15 sec. |
| Rinse 1 (35° C.) | 30 sec. | 30 sec. | 30 sec. |
| Rinse 2 (35° C.) | 30 sec. | 30 sec. | 30 sec. |
| Rinse 3 (35° C.) | 30 sec. | 30 sec. | 30 sec. |
| Drying (50° C.) | 1 min. | 1 min. | 1 min. |

In each of the processing methods D to F, the water washing process used the three-tank counterflow system in which the washing water flows from the tank for rinse 3 to that for rinse 1. In addition, the overflow from the bleaching bath was introduced into the bleaching-fixing bath in each method. In the processing method E, all the overflow from the color development tank was introduced into the bleaching bath. While, in the processing method F, all the overflow from the color development tank and all the overflow from the tank for rinse 1 was introduced into the bleaching-fixing tank.

The amount of replenishing solution for each processing solution was as follows:

| Kind of replenishing solution | Method D (ml/m) | Method E (ml/m) | Method F (ml/m) |
|---|---|---|---|
| Color Development | 18 | 18 | 18 |
| Bleaching A | 3 | 3 | 3 |
| Bleaching B | 12 | 12 | 12 |
| Water | 15 | — | — |
| Overflow from the Color Development Bath | — | 15 | 15 |
| Bleaching-Fixing | 15 | 15 | 15 |
| Water | 15 | 15 | — |
| Overflow from the Bleaching Bath | 25 | 25 | 25 |
| Overflow from the Tank for Rinse | — | — | 15 |
| Rinse | 18 | 18 | 18 |

The amount of each processing solution entrained with the color light-sensitive material was 3.0 ml per unit length (1 m) of the material.

The formulation of each processing solution used in this Example was as follows:

| | Solution contained in Tank | Replenishing Solution |
|---|---|---|
| Color Development Solution | | |
| Diethylenetriaminepentaacetic acid | 3.0 g | 3.0 g |
| Sodium sulfite | 4.0 g | 6.0 g |
| Potassium carbonate | 30.0 g | 30.0 g |
| Potassium bromide | 1.6 g | — |
| Potassium iodide | 3.0 mg | — |
| Hydroxylamie sulfate | 2.4 g | 3.0 g |
| 4-(N—ethyl-N—β-hydroxyethyl-amino)-2-methylaniline sulfate | 4.5 g | 6.0 g |
| Water (the amount required to obtain 1l of the solution) | | |
| pH | 10.00 | 10.10 |
| Bleaching Solution | | |
| EDTAFe(III)$NH_4$.2$H_2O$ | 120 g | |
| EDTA.2Na | 10 g | |
| Aqueous ammonia (26%) | 17 ml | |
| Ammonium nitrate | 10 g | |
| Ammonium bromide | 100 g | |
| Bleaching accelerator | 1.5 g | |
| Water (the amount required to obtain 1l of the solution) | | |
| pH | 6.5 | |
| Replenishing Solution A for Bleaching Bath | | |
| EDTA.2Na | 100 g | |
| The Foregoing bleaching accelerator | 20 g | |
| Ammonium bromide | 300 g | |
| Water (the amount sufficient to obtain 1000 ml of the solution) | | |
| pH | 4.2 | |
| Replenishing Solution B for Bleaching Bath | | |
| EDTA.2Na | 3 g | |
| Ammonium bromide | 180 g | |
| Ammonium nitrate | 30 g | |
| EDTAFe(III)$NH_4$.2$H_2O$ | 300 g | |
| Aqueous ammonia (26%) | 15 ml | |
| Water (the amount sufficient to obtain 1000 ml of the solution) | | |
| pH | 5.0 | |
| Bleaching-Fixing Solution for Bleaching-Fixing Bath | | |
| EDTAFe(III)$NH_4$.2$H_2O$ | 50 g | |
| EDTA.2Na | 5 g | |
| Sodium sulfite | 12 g | |
| Ammonium thiosulfate (70%) | 200 ml | |
| Aqueous ammonia (26%) | 10 ml | |
| Ammonium bromide | 50 g | |
| Water (the amount required to obtain 1l of the solution) | | |
| pH | 7.20 | |
| Replenishing Solution for Bleaching-Fixing Bath | | |
| Ammonium thiosulfate (70%) | 800 ml | |
| EDTA.2Na | 2 g | |
| Sodium bisulfite | 20 g | |
| Sodium sulfite | 30 g | |
| Aqueous ammonia (26%) | 10 ml | |
| Water (the amount required to obtain 1l of the solution) | | |
| pH (by the addition of aqueous ammonia) | 8.00 | |
| Solution for Rinse (The solution for tank and that for replenishing solution have the same formulation) | | |
| EDTA.2Na | 0.25 g | |
| Sulfanilamide | 0.1 g | |
| 1,2,3-benzotriazole | 0.2 g | |
| 5-Chloro-2-methyl-4-isothiazolin-3-one | 30 mg | |
| Formalin (37% by weight) | 0.5 ml | |
| Fuji Dry Well | 5.0 ml | |
| Water (the amount required to obtain 1l of the solution) | | |
| pH | 7.0 | |

During the running tests, the amount of overflow solution discharged from each processing bath was determined and the results obtained were as shown in the following Table 3. In Table 3, the amount of overflow discharged is expressed as milliliters per unit length (1 m) of the color lightsensitive material treated.

TABLE 3

| Overflow Solution | Method D (Comparative Example | Method E (Invention) | Method F (Invention) |
|---|---|---|---|
| Color Development | 15 | — | — |
| Bleaching | — | — | — |
| Bleaching-Fixing | 60 | 60 | 60 |
| Rinse | 15 | 15 | — |
| Total | 90 | 75 | 60 |

Moreover, photographic properties of the treated color light-sensitive materials were examined according to the same procedures as set forth in Example 1. There was observed no difference in such properties among the materials treated according to the methods D to F. This clearly means that the processing method of the present invention permits the reduction in the amount of waste liquor without impairing the photographic properties of the color light-sensitive material to be treated.

What is claimed is:

1. A processing method for a silver halide color photosensitive material comprising continuously treating a silver halide color photosensitive material using a multistep processing method including (i) a step of developing the material with a color developer which is substantially free of benzyl alcohol, and (ii) at least one additional processing step subsequent to the developing step, wherein at least a part of an overflow solution of the color developer is added to the processing solution of at least one of the subsequent processing steps, and wherein the overflow solution is added in an amount of 0.1 to 30 times the volume of color developer carried over by the photosensitive material.

2. The processing method according to claim 1 wherein the processing solution is a bleaching-fixing solution, a bleaching solution and/or a fixing solution.

3. The processing method according to claim 1 wherein the overflow solution of the color developer is used in an amount of 0.2 to 5 times the amount of a concentrated replenishing solution for the processing solution.

4. The processing method according to claim 1 wherein step (ii) the overflow solution from the development step is added to a water washing step and an overflow solution from the water washing process is further added to the processing solution of another treatment step other than the color developer.

5. The processing method according to claim 1 wherein the developer contains a primary aromatic amine in an amount of about 0.1 g to about 20 g per liter of the developer.

6. The processing method according to claim 1 wherein pH of the developer is 9 to 12.

7. The processing method according to claim 1 wherein the developer contains a buffering agent in an amount of not less than 0.1 mol/l.

8. The processing method according to claim I wherein the color developer contains benzyl alcohol in an amount of not more than 2 ml per 1 liter of the developer.

9. The processing method according to claim 1 wherein the color developer contains no benzyl alcohol.

10. The processing method according to claim 1 wherein step (ii) includes the step of treating the material in a fixing bath or bleach-and-fixing bath, which step is followed by treatment in a water washing bath having a multistage counterflow arrangement.

11. The processing method according to claim 1 wherein step (ii) includes treatment in a fixing bath or bleaching-and-fixing bath, which step is followed by treatment in a stabilization bath.

* * * * *